United States Patent [19]

Bergmeier et al.

[11] Patent Number: 5,048,815

[45] Date of Patent: Sep. 17, 1991

[54] GRIPPER DEVICE ON SHEET-FED ROTARY PRINTING MACHINES

[75] Inventors: Dieter Bergmeier, Heidelberg; Hans-Peter Hiltwein, Philippsburg, both of Fed. Rep. of Germany

[73] Assignee: Heidelberger Druckmaschinen AG, Heidelberg, Fed. Rep. of Germany

[21] Appl. No.: 518,209

[22] Filed: May 3, 1990

[30] Foreign Application Priority Data

May 3, 1989 [DE] Fed. Rep. of Germany ..... 3914646

[51] Int. Cl.[5] ..... B65H 29/04

[52] U.S. Cl. ..... 271/204; 271/206; 271/268

[58] Field of Search ..... 271/82, 85, 204, 206, 271/268, 277

[56] References Cited

U.S. PATENT DOCUMENTS

| | | | |
|---|---|---|---|
| 4,634,107 | 1/1987 | Vandersyde et al. | 271/85 X |
| 4,728,097 | 3/1988 | Vandersyde et al. | 271/168 |
| 4,781,370 | 11/1988 | Weisgerber | 271/277 |

FOREIGN PATENT DOCUMENTS

| | | | |
|---|---|---|---|
| 0212365 | 3/1987 | European Pat. Off. . | |
| 2337210 | 2/1975 | Fed. Rep. of Germany | 271/204 |
| 3710355 | 1/1988 | Fed. Rep. of Germany . | |
| 0667860 | 11/1988 | Switzerland | 271/204 |

*Primary Examiner*—Robert P. Olszewski
*Assistant Examiner*—Tuan N. Nguyen
*Attorney, Agent, or Firm*—Herbert L. Lerner; Laurence A. Greenberg

[57] ABSTRACT

A gripper device on a sheet-fed rotary printing machine formed of a sheet gripper seat and a sheet gripper, and having a gripper housing with a gripper arm swivellable about a gripper shaft, comprising an articulation point with an elastic restoring force on the gripper arm, the articulation point being disposed close to the start of a gripper finger having a pressure surface located on one side of a connecting line between a middle point of a gripper shaft and a front edge of the gripper-finger pressure surface, the articulation point being disposed at a location in an area starting from the connecting line and extending over a side of the connecting line located opposite to the side thereof in which the gripper finger is located.

19 Claims, 6 Drawing Sheets

FIG. 3
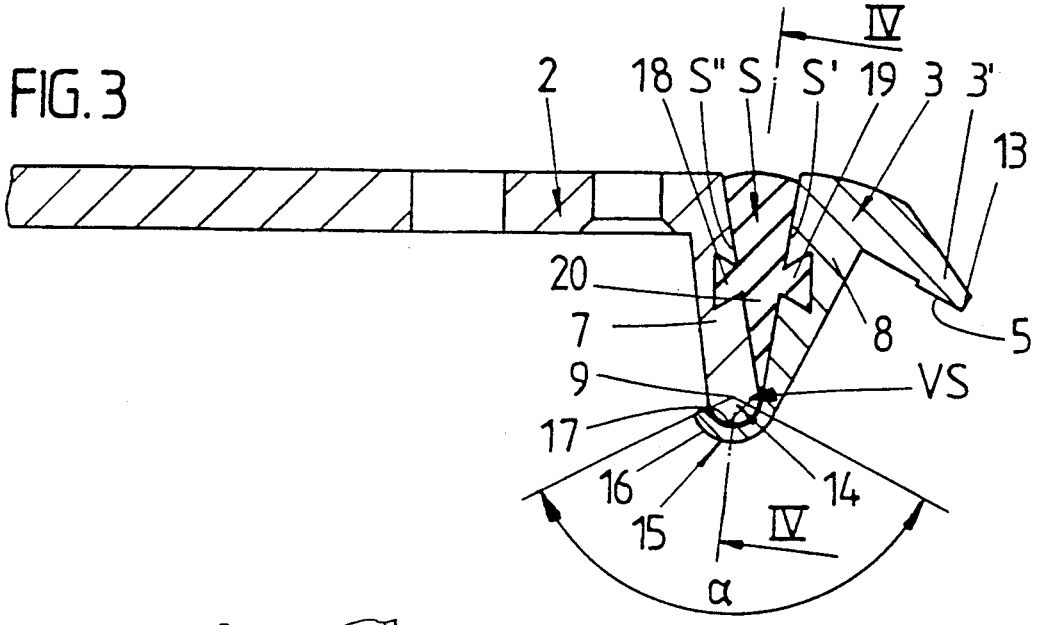
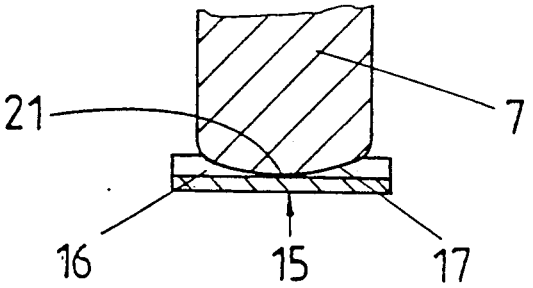
FIG. 4
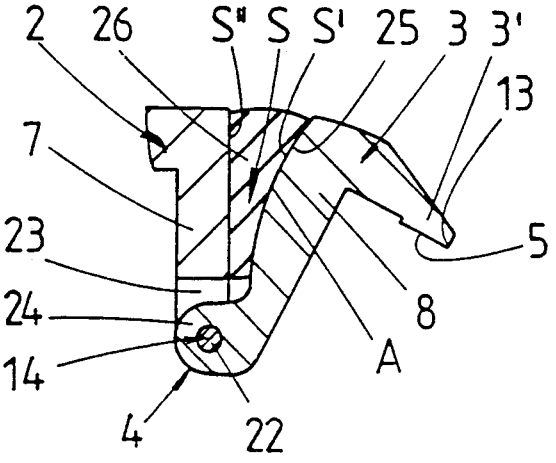
FIG. 5
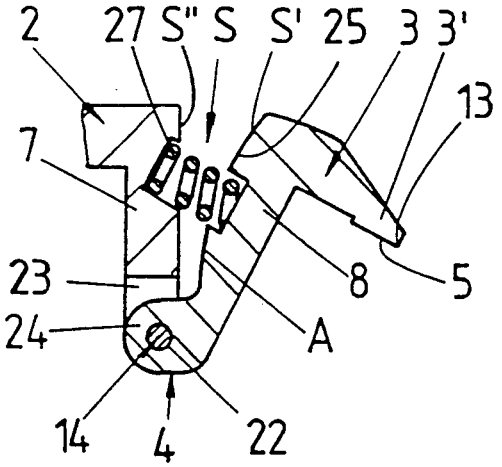
FIG. 6

FIG.13
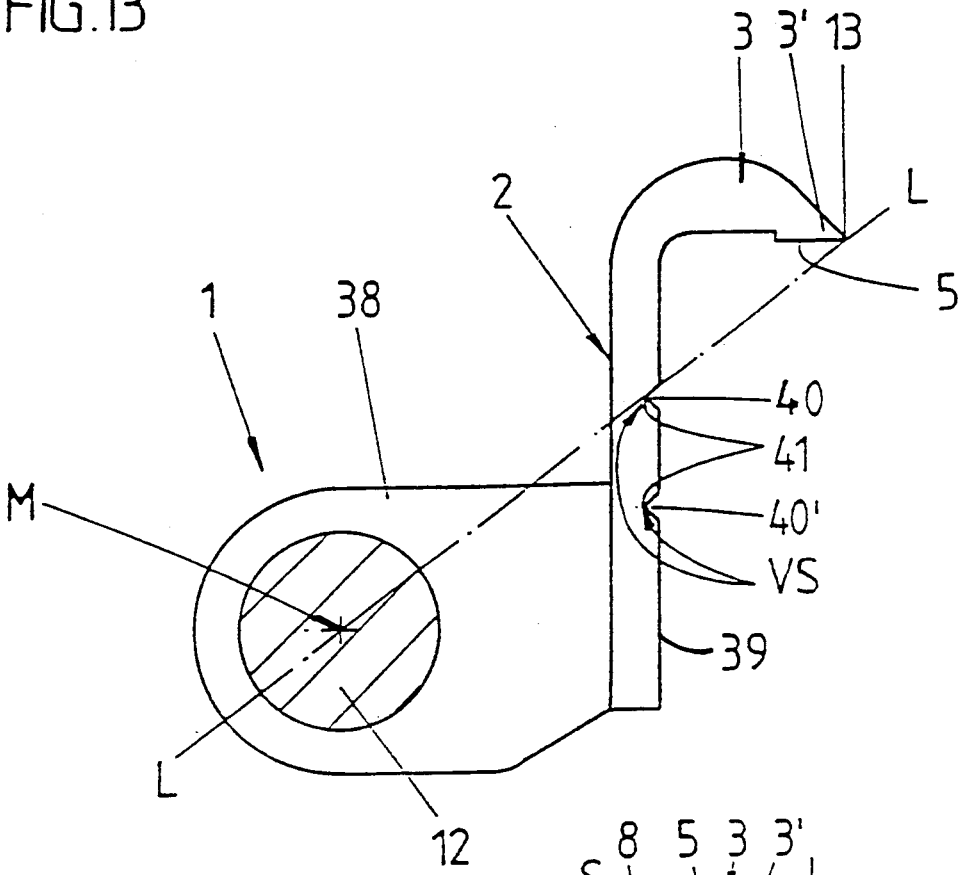
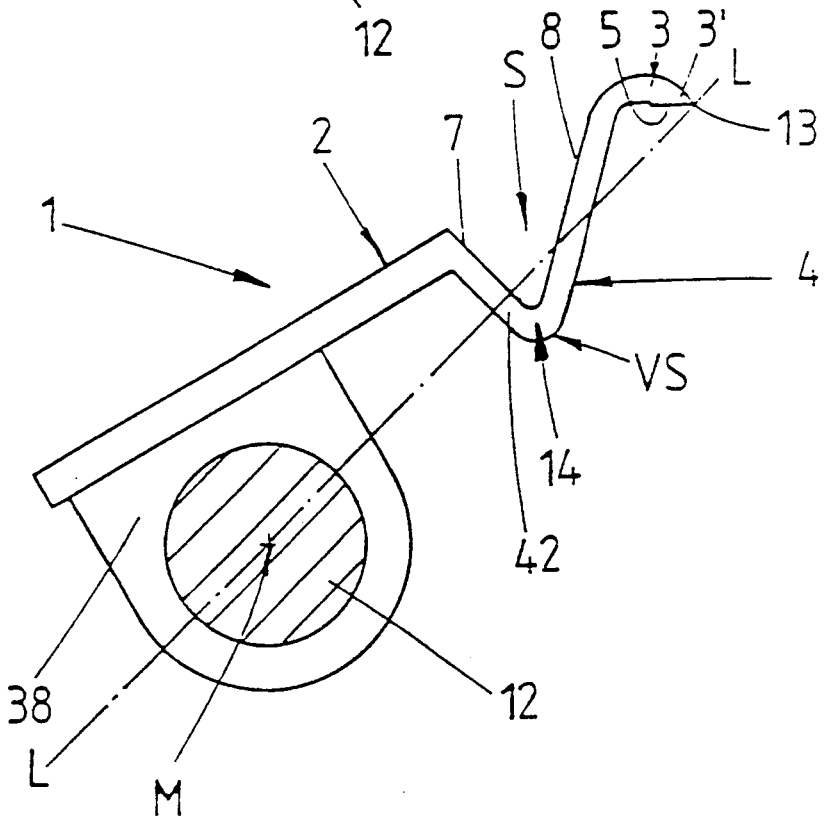
FIG.14

GRIPPER DEVICE ON SHEET-FED ROTARY PRINTING MACHINES

The invention relates to a gripper device on sheet-fed rotary printing machines, and, more particularly, to such a device formed of a sheet gripper seat and a sheet gripper, and having a gripper housing with a gripper arm swivellable about a gripper shaft.

In heretofore-known devices of this general type, as in German Published, Non-Prosecuted Application DE-OS 37 10 355, an effort has been made to ensure that the sheet is not displaced, in the direction of the circumference of the cylinder, from its positioned location in the mouth of the gripper, during the closing movement of the gripper.

Heretofore attempted solutions to this problem are far from perfect; an effect of the buckling or kinking of the gripper arm at the respective location, made possible by an articulation point, is that this buckling or kinking movement exerts a further pushing movement on the sheet which has already been gripped. This is undesirable, and disadvantageous not only for the positioning of the sheet on the respective cylinder, but also for the sheet material, depending upon the thickness and/or quality of the material to be printed. The respective articulation point may therefore, at any rate, only permit extremely small (buckling) movements.

It is accordingly an object of the invention of the instant application to provide a gripper device of the foregoing general type , with a similarly simple construction and without additional expense with respect to control engineering, which ensures that no further disadvantageous pushing movement is exerted on the sheet even after the gripper has been closed.

With the foregoing and other objects in view, there is provided, in accordance with the invention, a gripper device on a sheet-fed rotary printing machine formed of a sheet gripper seat and a sheet gripper, and having a gripper housing with a gripper arm swivellable about a gripper shaft, comprising an articulation point with an elastic restoring force on the gripper arm, the articulation point being disposed close to the start of a gripper finger having a pressure surface located on one side of a connecting line between a middle point of a gripper shaft and a front edge of the gripper-finger pressure surface, the articulation point being disposed at a location in an area starting from the connecting line and extending over a side of the connecting line located opposite to the side thereof in which the gripper finger is located.

In accordance with another feature of the invention, the articulation point is formed as an elastic kink bending point comprising means defining a gap extending from an upper side of the gripper into the gripper to approximately as far as the connecting line and formed by a V-shaped apex of a projection from the gripper finger located on the first-mentioned side of the connecting line, the projection projecting to below the sheet gripper seat.

In accordance with a further feature of the invention, the articulation point is formed by an articulation journal pin, and a pad incorporating the elastic restoring force is received in the gap.

In accordance with an added feature of the invention, the gap-defining means are limiting walls, and at least one contact surface between the pad and a respective gap-limiting wall has an arcuate shape.

In accordance with an additional feature of the invention, there is provided a pressure spring bridging the gap.

In accordance with again another feature of the invention, the pad is in form-locking or positive contact with at least one of the gap-limiting walls.

In accordance with again a further feature of the invention, the positive or form-locking contact is formed by dovetail projections of the pad.

In accordance with again an added feature of the invention, there is provided a leaf spring disposed in the gap.

In accordance with again an additional feature of the invention, there is provided a V-shaped connection between the gripper arm and the gripper finger, the V-shaped connection having a V-shaped apex, the articulation point being formed by a spring section disposed within a region of the V-shaped apex.

In accordance with yet another feature of the invention, the spring section is braced against lower legs of the V-shaped connection.

In accordance with yet a further feature of the invention, the gap-defining means are limiting walls, and including a spring section fastened in grooves formed in the gap-limiting walls.

In accordance with yet an added feature of the invention, there is provided a V-shaped connection between the gripper arm and the gripper finger, the articulation point being formed by an articulation pan-type connection contact, and V-legs of the V-shaped connection being hobbled to one another by a form-locking closure.

In accordance with yet an additional feature of the invention, the form-locking closure comprises an adhesive.

In accordance with still another feature of the invention, the form-locking closure comprises a sprayed-on coating of the pad.

In accordance with still a further feature of the invention, the V-shaped apex is reduced in cross section by a lateral constriction.

In accordance with still an added feature of the invention, the V-shaped apex is reduced in cross section by a central bore.

In accordance with still an additional feature of the invention, the articulation point is formed on a wide side of the gripper arm by at least one notch.

In accordance with still an additional feature of the invention, the gripper arm is disposed at an angle to the gripper housing.

In accordance with a concomitant feature of the invention, the gripper arm has a substantially uniform cross section, and is formed by a V-shaped extension from the gripper housing.

Due to the foregoing construction, a gripper device is created on sheet-fed rotary printing machines, with which an extremely precise positioning of the sheet is possible, due to the fact that, even after closing of the gripper and after any buckling of the gripper arm permitted by the articulation point, no further pushing movement or thrust-motion component from the region of the gripper mouth and opposite to the direction of rotation of the cylinder acts upon the sheet. Because the articulation point is situated on the respective connection line or below it (and in the latter case, as closely below it as possible), any shifting of the gripper finger in the direction of pushing or thrust ceases, after the finger has been placed on the sheet with subsequent movement about the articulation point.

A consequence thereof is that this movement of the gripper dependent upon the articulation point can, of itself, be performed without further disadvantages, over a larger path of movement which can be spring-loaded better, for example in order thereby to achieve, with the same means, those advantages which are achieved in the case of gripper devices of other constructions (e.g. European Published, Non-Prosecuted Application EP-OS 212 365) by constructing the surface of the gripper finger resting on the sheet as a non-elastic pressure member which, however, is carried by an intermediate elastic layer on the gripper finger. The invention according to the instant application can even bring about the cushioning effects achieved by such constructions, but without the inevitable pushing or thrust movements which occur with these heretofore-known constructions and which are exerted upon the sheet when the gripper closes.

Other features which are considered as characteristic for the invention are set forth in the appended claims.

Although the invention is illustrated and described herein as embodied in a gripper device on sheet-fed rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a sectional view of a second embodiment of the gripper arm according to the invention;

FIG. 4 is a cross-sectional view of FIG. 3 taken along the line IV—IV in the direction of the arrows;

FIG. 5 is a sectional view of a third embodiment of the gripper arm according to the invention;

FIG. 6 is a sectional view of a fourth embodiment of the gripper arm according to the invention:

FIG. 13 is a side elevational view of a tenth embodiment of the gripper device according to the invention: and FIG. 14 is a side elevational view of an eleventh embodiment of the gripper device according to the invention.

Figure 1:
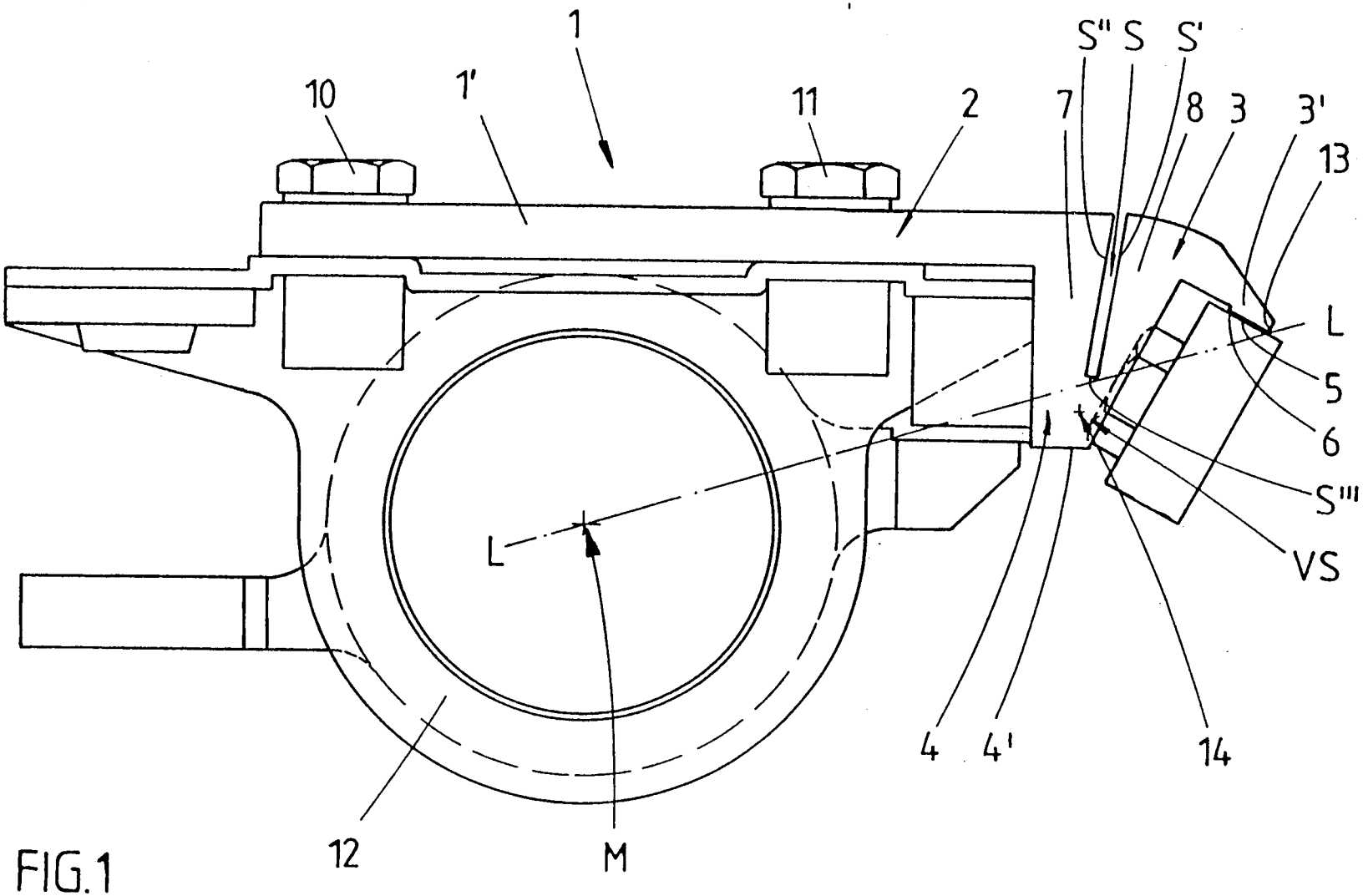
FIG. 1 is a side elevational view of a first embodiment of a gripper device according to the invention.
Figure 2:
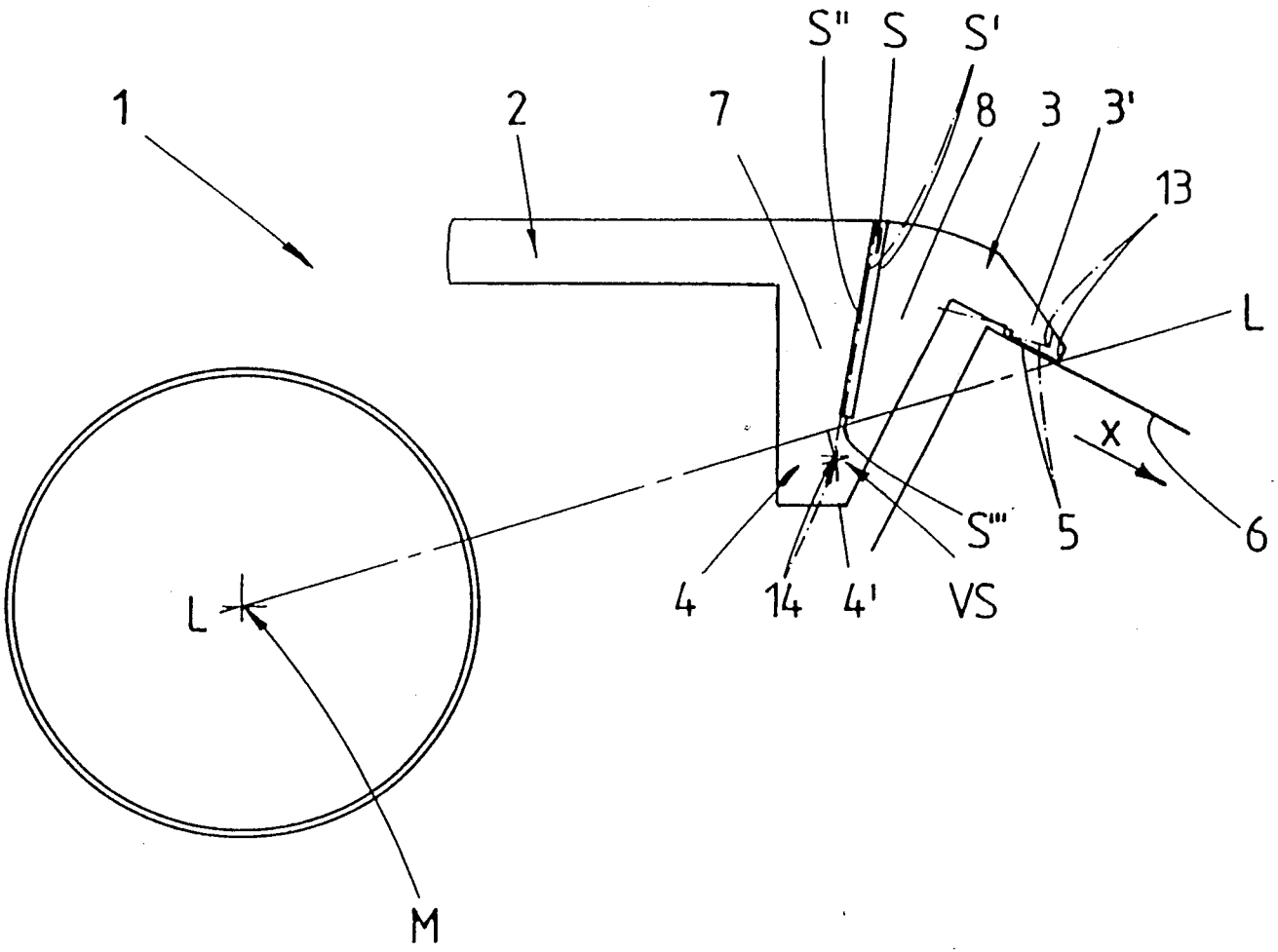
FIG. 2 is a diagrammatic view of FIG. 1 showing the course of movement of the gripper device.

Referring now to the drawings and, first, particularly to FIG. 1 thereof, there is shown therein a gripper device 1 having a gripper arm 2, a gripper finger 3 and a V-shaped connection 4 between the gripper finger 3 and the gripper arm 2. A pressure surface 5 of the gripper finger 3 is located opposite a sheet gripper support or seat 6. The V-shaped connection 4 has two legs 7 and 8 defining a gap S therebetween. At a vertex or apex VS of the V-shaped connection 4, an articulation point 14 is formed which lies approximately between a lower edge S''' of the gap S and a lower edge 4' of the V-shaped connection 4. The gripper arm 2 is fastened by a pair of screws 10 and 11 to a gripper housing 12, which is swivellable about a middle point M of a gripper shaft (according to FIG. 1). The pressure surface 5 of the gripper finger 3 is located at one side of a connecting line L—L between the middle point M of the gripper shaft and a front edge 13 of the gripper-finger pressure surface 5. The articulation point 14 is located on the other side of the connecting line L—L (or also exactly on the connecting line L—L). When the gripper shaft is rotated by only a few degrees around the middle point M, the V-apex VS which forms the articulation point 14 with elastic restoring force causes a narrowing of the gap S. This occurs after the gripper 1 has closed. Thus, due to the position of the articulation point, a displacement of a sheet in the circumferential direction of the cylinder, i.e. in the direction represented by the arrow x in FIG. 2, is prevented.

In FIG. 3, the articulation point 14 itself is not elastic. On the contrary, two separate V-legs 7 and 8 form a connection contact 15 having the nature of an articulating pan. The leg 8 has an arched or curved portion 15 with which it encloses a lower edge 17 of the leg 7 extending from the gripper arm 2. As shown in FIG. 3, the enclosing contact of the curved portion 15 is over an angle alpha of about 120 degrees. A restoring force is produced by an elastic pad 20 which in the embodiment of FIG. 3 is held in dovetail-shaped guides 18 and 19 formed in the gap-limiting walls S' and S'' of the legs 7 and 8. The pad 20 may also be glued or sprayed on. The lower edge 17 of the V-leg 7 has a convex protrusion 21, as can be seen in FIG. 4. This protrusion 21 offers as an advantage that, if the gripper-finger pressure surface 5 and the sheet gripper support or bearing 6 do not have an exactly parallel disposition opposite one another, the protrusion 21 automatically effects a paralellism because the leg 8 adjusts itself into parallel alignment with the sheet gripper support or seat 6. The unity or cohesive assembly of the parts 7 and 8 is, for example, provided adequately merely by means of the dovetail connection.

Figure 7:
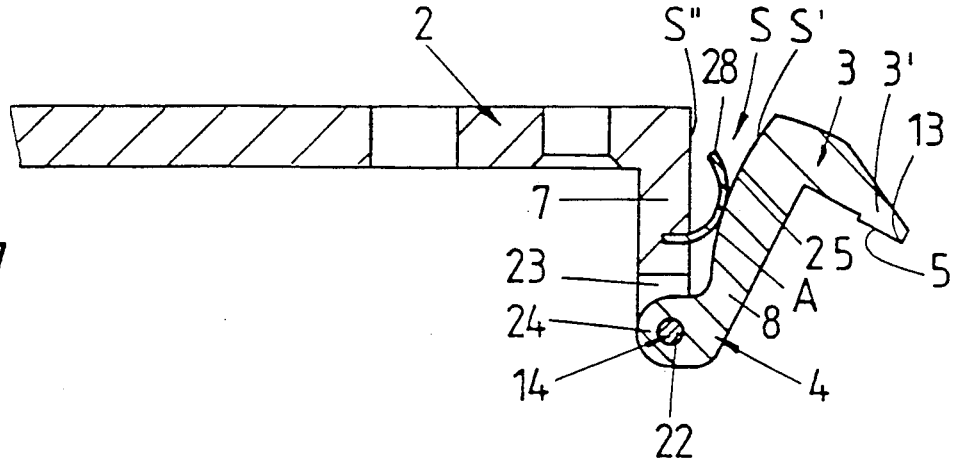
FIG. 7 is a sectional view of a fifth embodiment of the gripper arm according to the invention.

As shown in FIGS. 5 to 7, the articulation point 14 can be formed by means of a journal pin 22,.which is surrounded in the middle thereof by the V-leg 8, and carried at the respective ends thereof by the V-leg 7, which is formed with an incision or cut-out 23 extending upwardly from the bottom, in which the portion 24 of the V-leg surrounding the journal pin 22 can move. The V-leg 8 in the aforementioned three embodiments shown in the figures has an accurate gap-limiting wall S' forming a protrusion 25 which offers the advantage, amongst others, that the inserts producing the elastic restoring forces may be of different types; they can be constructed either as elastic pads 26, compression springs 27 leaf springs 28. The bulging or sphericity of the contact surface increases while the gap remains of equal size, which, for example, can be advantageous for the compression, and for any adhesive fastening, and the like.

Figure 8:
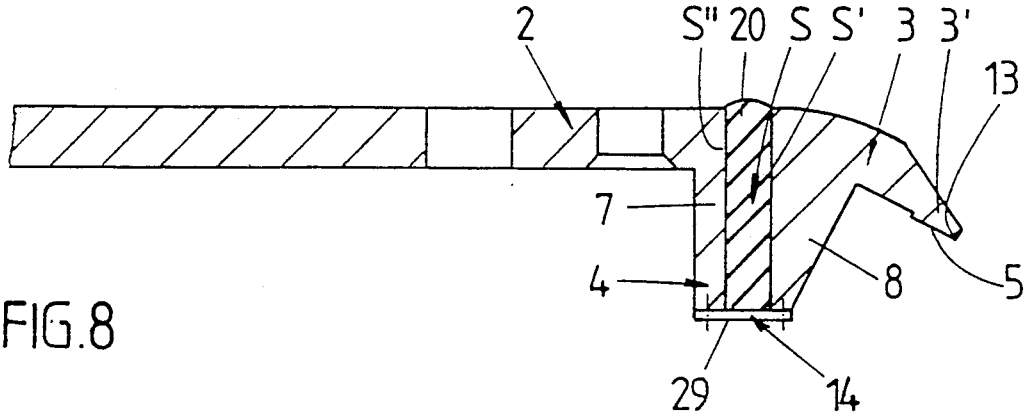
FIG. 8 is a sectional view of a sixth embodiment of the gripper arm according to the invention.
Figure 9:
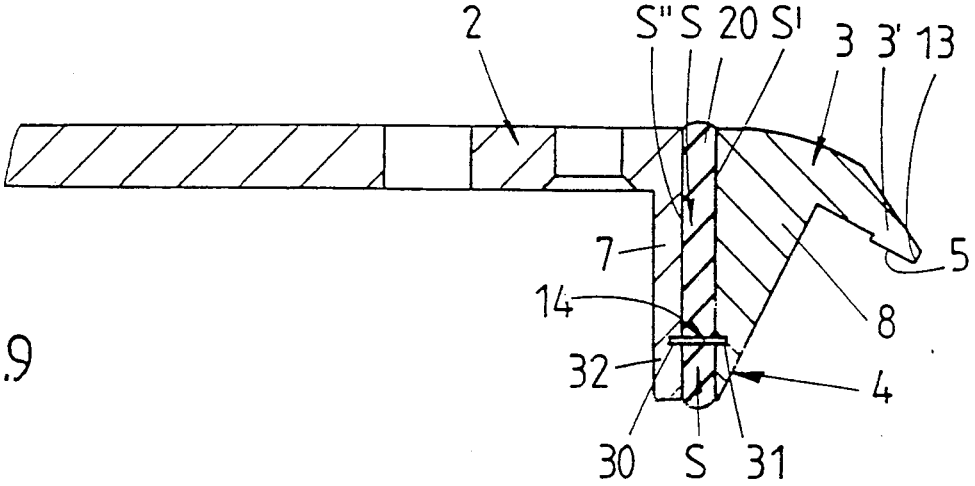
FIG. 9 is a sectional view of a seventh embodiment of the gripper arm according to the invention.

The articulation point 14 constructed as a spring section 29 in FIG. 8 and 9 is disposed at a right angle to the gap-limiting walls S' and S'' which accommodate the elastic pad 20 (e.g. formed of hard rubber or plastic) which produce the elastic restoring forces. In FIG. 8, the spring section 29 is placed from below against the V-legs 7 and 8. In FIG. 9, the spring section 29 forms a connection between the V-legs 7 and 8 by the introduction of leaf springs into grooves 30 and 31 formed in a lower quarter of the V-section 4.

Figure 10:
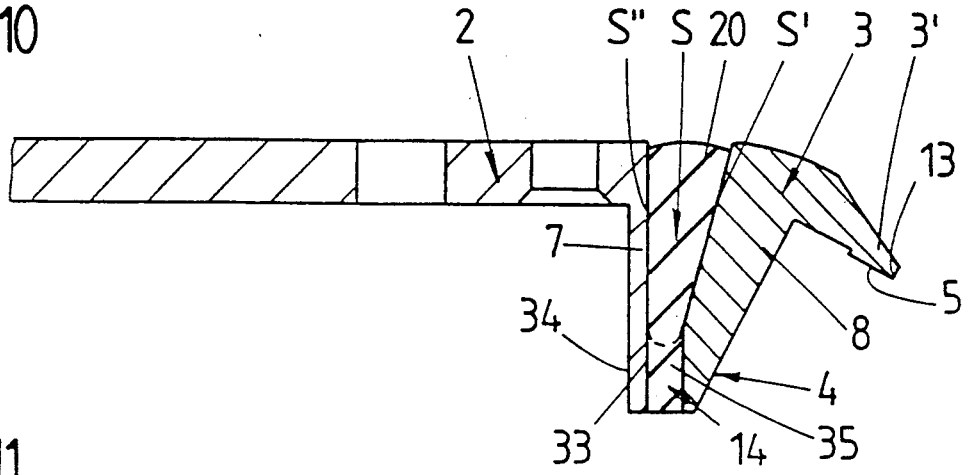
FIG. 10 is a sectional view of an eight embodiment of the gripper arm according to the invention.
Figure 11:
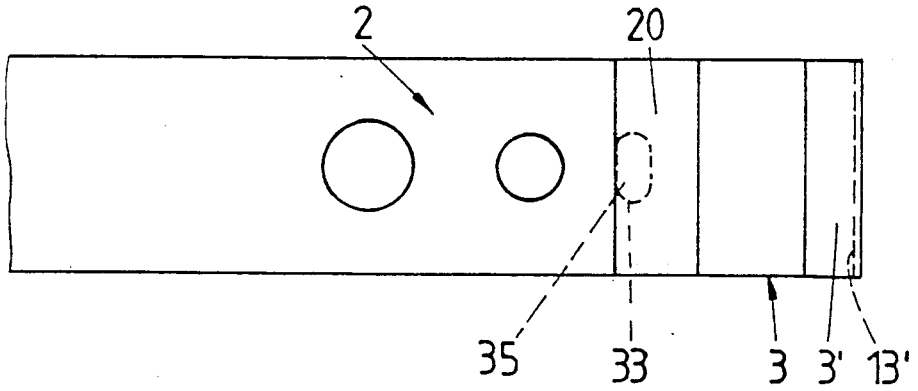
FIG. 11 is a top plan view of FIG. 10.

In FIGS. 10 and 11, the pad 20 is held in a longitudinal hole or slot or a bore 33 or several thereof. These are in a lower part 34 of the V-section 4. At the underside thereof, the elastic pad 20 is formed with a journal-like protrusion 35 which is approximately of the same diameter as that of the bore 33. The upper part of the pad 20 is somewhat wedge-shaped and is adapted to or matches the gap-limiting walls S' and S''. The lower part 34 of the V-section 4 forms the articulation point 14. The reduction through the hole 33 takes place in order to increase the ability for articulation.

Figure 12:
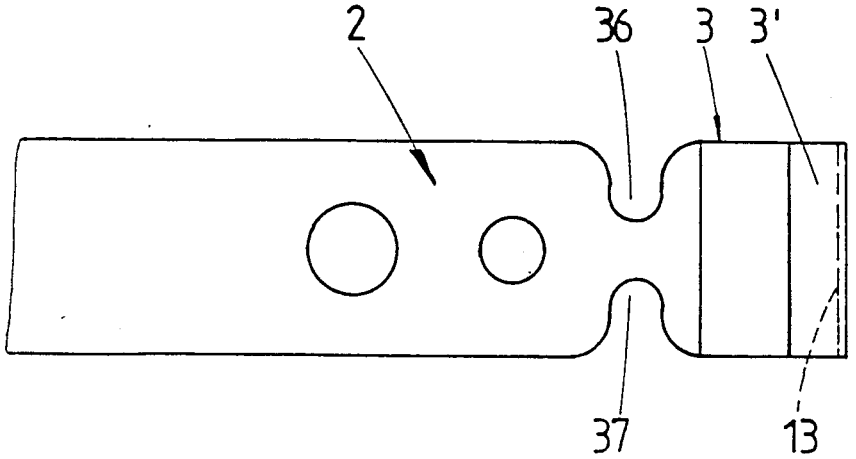
FIG. 12 is a top plan view of a ninth embodiment of the gripper arm according to the invention, which includes a modification of the structure shown in FIG. 11.

As can be seen in FIG. 12, the V-apex or vertex VS can also form its elastic restoring forces by means of an externally starting narrowing through a lateral constriction 36, 37.

In the embodiment according to FIG. 13, wherein the gripper arm 2 is disposed at an angle to the gripper housing 38, notches 40 and 40' formed in a side 39 of the gripper arm 2, and the section located therebetween, respectively, form a kink bending location 41, which then represents the articulation point.

In the gripper device 1 represented in FIG. 14, the gripper arm 2 is formed by a V-shaped extension 42 of uniform cross section. The V-apex or vertex VS is located approximately in the middle of the connecting line L—L as the reversal point during the course of the gripper arm 2.

In all of the illustrated embodiments of the invention, the V-apex or vertex VS or the articulation point 14 lies below the line L—L. The V-legs dip more or less radially into a suitable cylinder recess or channel.

The foregoing is a description corresponding in substance to German Application P 39 14 646.4, dated May 3, 1989, the International priority of which is being claimed for the instant application, and which is hereby made part of this application. Any material discrepancies between the foregoing specification and the aforementioned corresponding German application are to be resolved in favor of the latter.

We claim:

1. Gripper device on a sheet-fed rotary printing machine formed of a sheet gripper seat and a sheet gripper, and having a gripper housing with a gripper arm swivellable about a gripper shaft, comprising an articulation point with an elastic restoring force on the gripper arm, said articulation point being disposed close to the start of a gripper finger having a pressure surface located on one side of a connecting line between a middle point of the gripper shaft and a front edge of the gripper-finger pressure surface, said articulation point being disposed at a location in an area starting from said connecting line and extending over a side of said connecting line located opposite to the side thereof in which the gripper finger is located.

2. Gripper device according to claim 1, wherein said articulation point is formed as an elastic kink bending point comprising means defining a gap extending from an upper side of the gripper into the gripper to approximately as far as said connecting line and formed by a V-shaped apex of a projection from said gripper finger located on said first-mentioned side of said connecting line, said projection projecting to below the sheet gripper seat.

3. Gripper device according to claim 2, wherein said articulation point is formed by an articulation journal pin, and a pad incorporating the elastic restoring force is received in said gap.

4. Gripper device according to claim 3, wherein said gap-defining means are limiting walls, and at least one contact surface between said pad and a respective gap-limiting wall has an arcuate shape.

5. Gripper device according to claim 2, including a pressure spring bridging said gap.

6. Gripper device according to claim 4, wherein said pad is in form-locking or positive contact with at least one of said gap-limiting walls.

7. Gripper device according to claim 6, wherein said positive or form-locking contact is formed by dovetail projections of said pad.

8. Gripper device according to claim 2, including a leaf spring disposed in said gap.

9. Gripper device on a sheet-fed rotary printing machine formed of a sheet gripper seat and a sheet gripper, and having a gripper housing with a gripper arm swivellable about a gripper shaft, comprising an articulation point with an elastic restoring force on the gripper arm, said articulation point being disposed close to the start of a gripper finger having a pressure surface located on one side of a connecting line between a middle point of the gripper shaft and a front edge of the gripper-finger pressure surface, said articulation point being disposed at a location in an area starting from said connecting line and extending over a side of said connecting line located opposite to the side thereof in which the gripper finger is located, and including a V-shaped connection between the gripper arm and said gripper finger, said V-shaped connection having a V-shaped apex, said articulation point being formed by a spring section disposed within a region of said V-shaped apex.

10. Gripper device according to claim 9, wherein said spring section is braced against lower legs of said V-shaped connection.

11. Gripper device according to claim 3, wherein said gap-defining means are limiting walls, and including a spring section fastened in grooves formed in said gap-limiting walls.

12. Gripper device on a sheet-fed rotary printing machine formed of a sheet gripper seat and a sheet gripper, and having a gripper housing with a gripper arm swivellable about a gripper shaft, comprising an articulation point with an elastic restoring force on the gripper arm, said articulation point being disposed close to the start of a gripper finger having a pressure surface located on one side of a connecting line between a middle point of the gripper shaft and a front edge of the gripper-finger pressure surface, said articulation point being disposed at a location in an area starting from said connecting line and extending over a side of said connecting line located opposite to the side thereof in which the gripper finger is located, and including a V-shaped connection between the gripper arm and said gripper finger, said articulation point being formed by an articulation pan-type connection contact, and V-legs of said V-shaped connection being secured to one another by a form-locking closure.

13. Gripper device according to claim 12, wherein said form-locking closure comprises an adhesive.

14. Gripper device according to claim 12, wherein said form-locking closure comprises a sprayed-on coating.

15. Gripper device according to claim 12, wherein said V-shaped apex is reduced in cross section by a lateral constriction.

16. Gripper device according to claim 2, wherein said V-shaped apex is reduced in cross section by a central bore.

17. Gripper device according to claim 1, wherein the gripper arm is formed with at least one notch on a side of the gripper arm facing away from the gripper shaft, said articulation point being located in vicinity of said one notch.

18. Gripper device according to claim 17, wherein the gripper arm is disposed at an angle to the gripper housing.

19. Gripper device according to claim 18, wherein the gripper arm has a substantially uniform cross section and is formed by a V-shaped extension from the gripper housing.

* * * * *